US012409985B2

(12) United States Patent
Betancourt Chapa

(10) Patent No.: US 12,409,985 B2
(45) Date of Patent: Sep. 9, 2025

(54) DISPENSER CONTAINER WITH SOUND EMITTER

(71) Applicant: Polychem SA de CV, Iztapalapa (MX)

(72) Inventor: Jorge Alberto Betancourt Chapa, Monterrey (MX)

(73) Assignee: Polychem SA de CV, Mexico City (MX)

( * ) Notice: Subject to any disclaimer, the term of this patent is extended or adjusted under 35 U.S.C. 154(b) by 98 days.

(21) Appl. No.: 18/462,985

(22) Filed: Sep. 7, 2023

(65) Prior Publication Data

US 2025/0026545 A1 Jan. 23, 2025

(30) Foreign Application Priority Data

Jul. 17, 2023 (MX) ..... /U/2023/000278

(51) Int. Cl.
*B65D 47/08* (2006.01)

(52) U.S. Cl.
CPC ..... *B65D 47/0857* (2013.01); *B65D 2251/01* (2013.01); *B65D 2251/205* (2013.01)

(58) Field of Classification Search
CPC ..... B65D 2203/12; B65D 51/248; B65D 2251/01; B65D 47/0857; B65D 83/06; A47G 19/24
USPC ..... 215/220; 446/213, 176, 204, 216; 206/39; 426/115, 531
See application file for complete search history.

(56) References Cited

U.S. PATENT DOCUMENTS 8,136,684 B2 * 3/2012 Becotte ..... B65D 51/242 215/390
2014/0055275 A1 * 2/2014 Lien ..... G01S 17/02 215/386
2022/0002044 A1 * 1/2022 Glaser ..... A01K 15/025

FOREIGN PATENT DOCUMENTS

KR 95-2416 4/1995

* cited by examiner

*Primary Examiner* — Nathan J Jenness
*Assistant Examiner* — Sanjidul Islam
(74) *Attorney, Agent, or Firm* — Michael J. Brown

(57) ABSTRACT

The present invention refers to a dispensing container for granular or pasty products, which has a container and a lid with outlet holes for the product to be dispensed, which includes a sliding sound-emitting device which compresses the air, making it pressurized out through openings, causing a funny sound when shaking or shaking the container.

7 Claims, 5 Drawing Sheets

DISPENSER CONTAINER WITH SOUND EMITTER

TECHNICAL FIELD OF THE INVENTION

The present invention is directed to the dispensing container industry, especially for small containers manually actuated by shaking or shaking the container, more particularly the invention refers to a dispensing container that has a sound-emitting device, which is activated by manually shaking the container to dispense the product, wherein said sound-emitting device is of the sliding type, compressing the air inside a cavity to cause sound at the air outlet.

BACKGROUND

Currently there is a wide variety of dispensing containers for granular or pasty products on the market, which have holes in their lid so that the user can perform the manual action of shaking it on the desired surface, such as dispensing containers such as salt or pepper shakers, however, these containers do not provide any special attraction for the user, except for the ornamental design of the container itself, making this operation monotonous. The present invention refers to solving this problem since it consists of a dispensing container that, when carrying out the operation of shaking the container to extract the product emits a funny sound for the user, providing a second benefit.

Within the state of the art we can find the document KR950002416Y1, which refers to a toy that emits a sound when children move it from one side to another, displacing the air contained inside to produce a wide range of sound from the toy, however, said document does not refer to a dispenser container like the present invention, and the structural technical characteristics of the sound-emitting device are also different.

Also within the state of the art there is document U.S. Pat. No. 6,892,674, which refers to a toy that emits variable sounds, which comprises an assembly of a first material that forms the part of the body of the article, composed of substantially elastomeric and hollow materials, and a second part that forms a cylindrical frame composed of substantially rigid materials, said cylindrical frame also comprises an integrated sound tube device with an associated sliding whistle component forming an air opening inside the tubular wall of said sound tube and is positioned so that it is enveloped by the interior cavity of the toy body portion, whereby physical compression or expansive decompression of the toy body portion will directionally drive air into and through said sound tube device, however said document does not refer to a dispensing package as of the present invention and the sound emitting device is also different.

Document U.S. Pat. No. 2,777,607 refers to a manual dispensing container for fluid material and more specifically to a shaker-type container with sound-emitting means, which has incorporated a sound-emitting means that works when the container is put into use, this being attractive to a small child while maintaining the child's attention, where the sound-emitting device will not be able to loosen even during vigorous shaking of the contents of the container, having dual functions, this sound-emitting device is integrated by an accordion-type bellows body arranged in the base of the container, which when the container is placed vertically moves a counterweight compressing the bellows and emitting sound, which brings many disadvantages since for the counterweight to compress the bellows the container must be almost vertical and also a compartment must be provided inside the special container for the bellows, which generates an empty space, decreasing the amount of product contained in the container, and the sound emitting device is also completely different from that of the dispensing container of the present invention.

These objects and advantages of the present invention will become apparent during the course of the following detailed description of the invention, taken in connection with the accompanying drawings.

DETAILED DESCRIPTION

Figure 1:
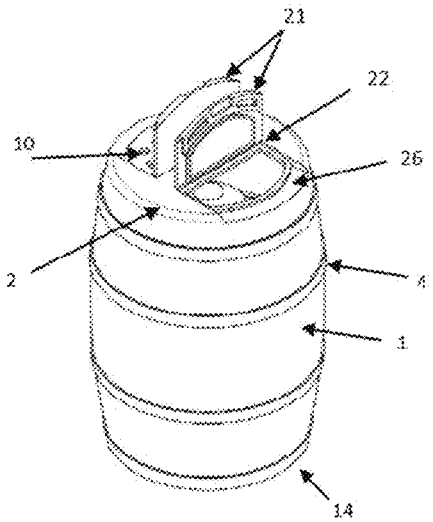
FIG. 1 is a perspective view of the assembled dispensing package.
Figure 2:
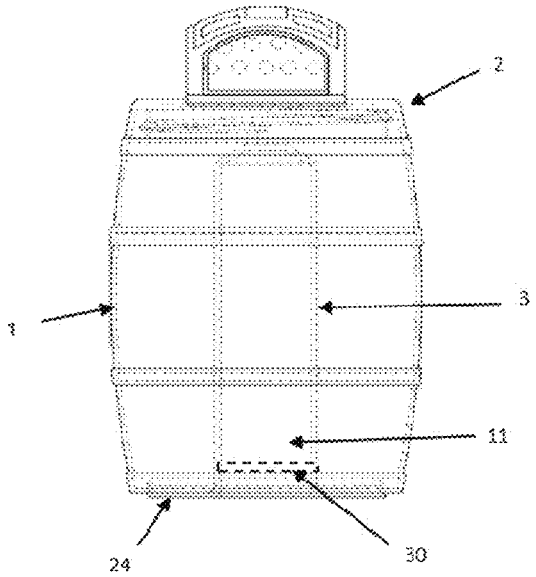
FIG. 2 is a front view of the open dispenser package.
Figure 3:
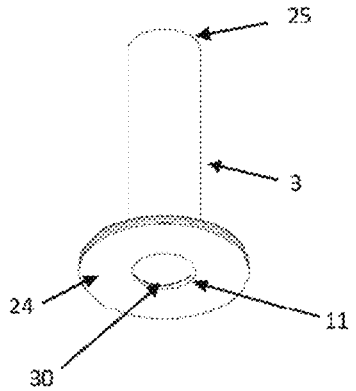
FIG. 3 is a perspective view of the bottom or base of the container with the integrated tube.
Figure 4:
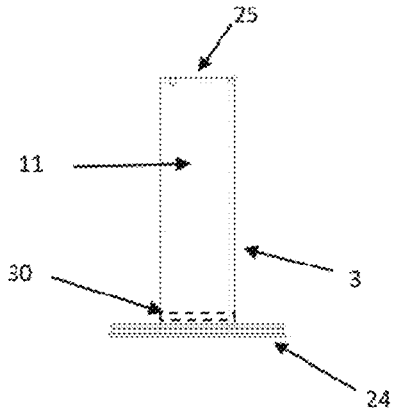
FIG. 4 is a side view of the bottom or base of the container with the integrated tube.
Figure 5:
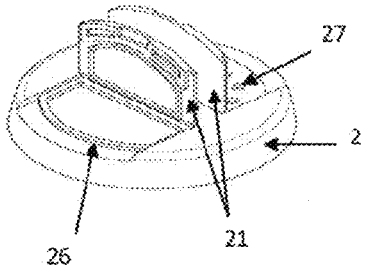
FIG. 5 is a perspective view of the lid of the container.
Figure 6:
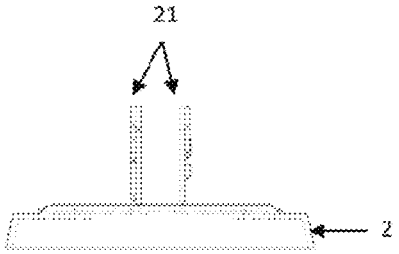
FIG. 6 is a side view of the lid of the container.
Figure 7:
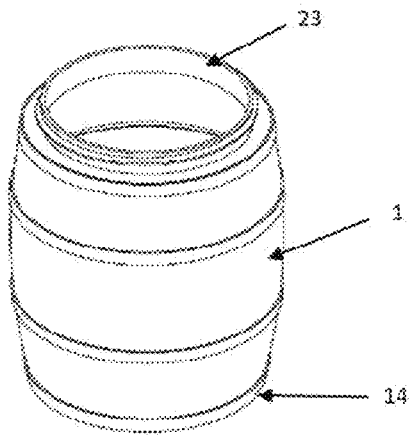
FIG. 7 is a perspective view of the container.
Figure 8:
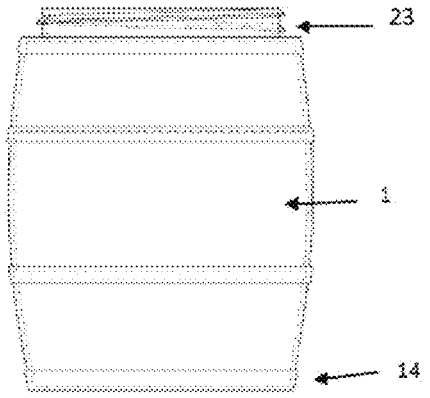
FIG. 8 is a front view of the container.
Figure 9:
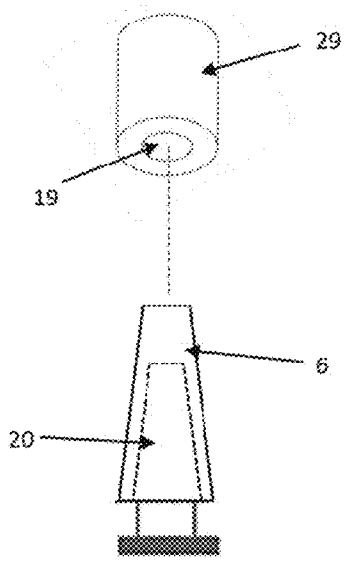
FIG. 9 is a side view of the sound emitting member being assembled with the bushing.
Figure 10:
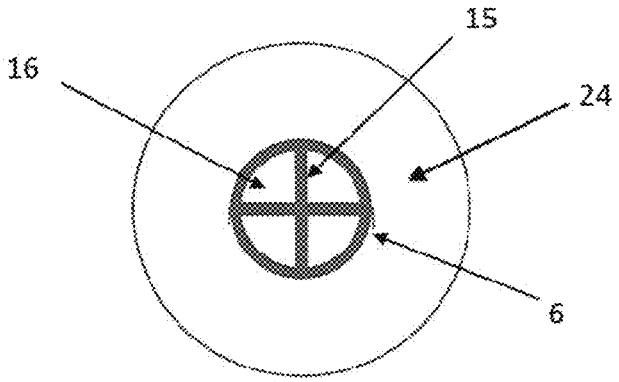
FIG. 10 is a bottom view of the base with the emitting member sound inside.

The present invention refers to a dispensing container for granular or liquid or pasty products, such as salt or chili powder or similar products, which, in addition to dispensing the product, performs this action in a fun way, giving the product additional use while the product is being poured.

The dispensing container of the present invention is made up of a cylindrical container (1), similar to a barrel or cask, with a lower end (14) and an open upper end. Said container (1) is hollow, and on its outside the container can have annular outer ribs (4) to resemble a barrel, and which can serve to have a better grip on the dispensing container.

The dispensing container has a container (1) that is cylindrical or in the shape of a hollow barrel, with its upper (23) and lower (14) ends open, an upper lid (2) made up of a perimeter skirt and an upper surface, with a first dispensing section (26) made up of a wide opening and a second dispensing section (27) diametrically opposite to the first made up of a panel with a plurality of holes (10), both dispensing sections (26 and 27) have closing flaps (21) hinged by means of a fold line (22) that keeps them attached to the lid (2).

This lid (2) is easy to open and close, screw-type lid with double "flap" or double closing flap that acts on a first dispensing section (26) wide enough to insert a small spoon and on a second dispensing section (27) type salt shaker, it also includes an internal security seal or gasket (not illustrated) that hermetically seals the lid (2) with the upper edge (23) of the container (1), avoiding any leakage of powders avoiding the leakage of fine powders from the containers. of the state of the art.

Said container has a base or bottom (24) of a circular shape, to close the lower end (14) of the container (1) under pressure, avoiding additional glues and powder leaks. Said base (24) has an integral part of it, forming a single piece, with a hollow tube (3) that projects upwards from the central part of the base (24), said tube (3) is closed at its upper end (25) and open at its lower end, so that when said base (24)

is inserted under pressure into the lower end (14) of the container (1), the tube (3) remains inside the container (1), defining an interior conduit (11).

By having the base (24) with the tube (3) integrated into it in a single piece, the union between pieces is avoided, unions that can generate leaks of fine powders or the use of additional materials such as food grade glue to prevent said leaks or the different pieces from separating.

Likewise, the lower edge of the tube (3) has an internal annular flange (30), so that it allows the plastic sleeve or bushing (29) to press into the interior conduit (11) of the tube (3), but it does not come out unless part of the base (24) is destroyed. With this configuration, the use of additional parts such as securing rings to imprison the sleeve or bushing (29) inside the tube (3) is avoided.

The container of the present invention has a sound emitting device, which is activated each time the user shakes the container to pour the product, said sound emitting device is arranged inside the interior conduit (11) defined by the hollow tube (3), through which said sound emitting device runs from top to bottom, said sound emitting device has a plastic sleeve (29), and includes a sliding sound emitting member (6), which is coupled in the center of the longitudinal channel (19) of the sleeve (29), said member sound emitter (6) consists of a hollow cylindrical or conical body with an air inlet, an internal tongue (20) and a pair of cross-shaped arms (15) at its lower end between which air outlet openings (16) are formed, so that the sound emitting member (6) together with the sleeve (29) slide freely along the interior conduit (11) of the tube (3) as the container is shaken, and when shaking or shaking the container, the emitting member (6) together with the sleeve (29) run allowing air to enter the interior conduit (11) and almost immediately changes direction due to the agitation of the container that the user causes with his hand, now moving to the opposite side compressing the air trapped inside the interior conduit (11), which increases its speed due to compression quickly exiting through the openings (16) that are formed between the arms (15) and passing through the tongue (20) causing the air to escape without gold, emitting a funny sound, which is repeated periodically as the container is shaken at the same time that the granular product is dispensed, achieving 1 carry out this action in a more fun way.

Once the sound emitting device is inserted into the tube (3), the base (24) is assembled in the container (1), it is filled with the granular product to be dispensed through the mouth of the container, and then the pre-assembled lid (2) is attached.

The sound-emitting member (6) has an internal acrylic tongue (20), which vibrates when the air passes through, causing a single-tone whistle. However, by changing the length of this tongue (20), the sounds can vary their tone, from more serious to more acute, which can be used to play with different sounds in the different flavors of the packaged products, that is, depending on the type of granular product, the container emits a different sound tone.

The invention claimed is:

1. A dispenser container for granular or liquid or pasty products, which has: a cylindrical hollow container (1), with a lower end and an open upper end; a base (24) arranged at the lower end of the container; a lid (2) arranged at the upper end of the container (1) closing its upper end, said lid (2) has at least one dispensing section for the output of the product to be dispensed; a hollow cylindrical tube (3), which projects upwards from a central part of the base, remaining inside the container (1), the hollow cylindrical tube (3) comprises a closed upper end and an open lower end, defining an interior conduit (11); a sleeve (29) which houses a sliding sound emitting member (6), characterized in that the base or bottom (24) and the tube (3) closed at its upper end form a unitary body, and the base is coupled under pressure to the lower end of the container and said base (24) is integrally attached to the hollow tube (3), forming a single piece, which projects upwards from the central part of the base (24).

2. A dispenser container for granular or liquid or pasty products according to claim 1, characterized in that the sleeve (29) is made of plastic.

3. A dispensing container for granular or liquid or pasty products according to claim 1, characterized in that the upper lid (2) is made up of a perimeter skirt and an upper surface, with a first dispensing section (26) made up of a wide opening and a second dispensing section (27) diametrically opposite to the first made up of a panel with a plurality of holes (10), both dispensing sections (26 and 27) have flaps closure (21) hinged by means of a fold line (22) that keeps them attached to the lid (2).

4. A dispenser container for granular or liquid or pasty products according to claim 1, characterized in that it includes an internal security seal or packing that hermetically seals the lid (2) with an upper edge (23) of the container (1), avoiding any leakage of fine powders.

5. A dispenser container for granular or liquid or pasty products according to claim 1, characterized in that the tube (3) has an inner annular flange (30) at a lower edge, so that the tube allows the plastic sleeve (29) to press into the interior conduit (11) of the tube (3), but not come out.

6. A dispenser container for granular or liquid or pasty products according to claim 1, characterized in that the sliding sound emitting member (6) is coupled in the center of a longitudinal channel (19) of the sleeve (29), said sound emitting member (6) consists of a hollow cylindrical or conical body with an air inlet, an internal tab (20) and a pair of cross-shaped arms (15) at a lower end of the sound emitting member between which cross-shaped arms air outlet openings (16) are formed so that the sound emitting member (6) together with the sleeve (29) slide freely along the interior conduit (11) of the tube (3) as the container is shaken, and when shaking or shaking the container, the emitting member (6) together with the sleeve (29) slide, allowing air to enter the interior conduit (11) and almost immediately changes direction due to the shaking of the container that a user causes with his hand, now moving towards the opposite side, compressing the air trapped inside the interior conduit (11), which increases interior conduit speed due to compression, rapidly exiting through the openings (16) that are formed between the arms (15) and passing through the tongue (20), causing the air to escape with noise.

7. A dispenser container for granular or liquid or pasty products according to claim 1, characterized in that the sound-emitting member (6) has an internal acrylic tongue (20), which vibrates when the air passes through, causing a single-tone whistle, however, by changing the length of the internal tongue (20), the sounds can vary their pitch.

* * * * *